US007234206B2

(12) United States Patent
Mascheretti et al.

(10) Patent No.: US 7,234,206 B2
(45) Date of Patent: Jun. 26, 2007

(54) CONNECTOR FOR CONNECTING A FIBRE FEEDING DUCT TO AT LEAST ONE TEXTILE MACHINE

(75) Inventors: Mario Mascheretti, Palazzolo Sull'Oglio (IT); Claudio Locatelli, Capriolo (IT)

(73) Assignee: Marzoli S.p.A., Bescia (IT)

( * ) Notice: Subject to any disclaimer, the term of this patent is extended or adjusted under 35 U.S.C. 154(b) by 510 days.

(21) Appl. No.: 10/777,782

(22) Filed: Feb. 13, 2004

(65) Prior Publication Data

US 2004/0231107 A1 Nov. 25, 2004

(30) Foreign Application Priority Data

Mar. 27, 2003 (EP) ..... 03425193

(51) Int. Cl.
*D01B 3/00* (2006.01)

(52) U.S. Cl. ..... 19/205

(58) Field of Classification Search ..... 19/204–205, 19/98, 105, 296, 145.5, 145.7
See application file for complete search history.

(56) References Cited

U.S. PATENT DOCUMENTS 3,029,477 A 4/1962 Wildbolz et al.
3,157,440 A * 11/1964 Hijiya et al. ..... 406/93
4,689,857 A * 9/1987 Pinto ..... 19/105
4,968,188 A 11/1990 Lucassen
4,988,373 A * 1/1991 Marzoli et al. ..... 55/461
5,247,722 A * 9/1993 Leifeld ..... 19/105
5,287,599 A * 2/1994 Leifeld ..... 19/205
5,819,373 A * 10/1998 Schlichter et al. ..... 19/205
2004/0231107 A1* 11/2004 Mascheretti et al. ..... 19/98

FOREIGN PATENT DOCUMENTS

DE 39 28 752 3/1991
EP 0 709 500 A 5/1996
FR 2 121 890 8/1972

* cited by examiner

*Primary Examiner*—Gary L. Welch
*Assistant Examiner*—Andrew W. Sutton
(74) *Attorney, Agent, or Firm*—Hogan & Hartson LLP

(57) ABSTRACT

A connector (10) for a duct (1) for the pneumatic feeding of fibre to at least one carding machine (2) has an upstream portion (14) and a side duct (18) having a through opening (20) for fibre feeding to the carding machine (2).

The connector comprises "stepped" means (22) for deflecting the stream of fibre, and lead-in bevels (41, 42) or a closing wall (100) inclined for the end-of-line connector, in order to even out the density of fibre sent to the carding machine.

38 Claims, 8 Drawing Sheets

CONNECTOR FOR CONNECTING A FIBRE FEEDING DUCT TO AT LEAST ONE TEXTILE MACHINE

The present invention relates to a connector for connecting a fibre feeding duct to at least one textile machine, and in particular to at least one carding machine. The said invention relates especially, but not exclusively, to the connector, also known as a distributor, for connecting a pneumatic fibre feeding duct to many series- or parallel-fed carding machines.

In one arrangement known in the art, the fibre is transported along the duct by the propulsion action of a stream of air generated by suitable means, such as a fan etc. This feeding system is known as the pneumatic fibre feeding system.

A fibre processing line comprises one or more carding machines fed by a feeding duct which connects machines upstream of the carding machines, such as an opener, a dust separator and a cage condenser, with the carding machines, specifically with the chute feed which is upstream of each of these.

The connection between the duct and the chute feed of the carding machine is provided by a connector, or distributor, which includes a portion for connection to the chute feed of the carding machine.

Some known solutions employ a fibre feeding duct having a resisting block that interferes with the stream of fibre in the duct, deflecting it forcibly towards the side.

A solution that has the features mentioned above is disclosed, for example, in document U.S. Pat. No. 3,157,440.

However, the forms described in the prior art have the disadvantage of conveying the fibre inside the chute feed with a swirling, turbulent motion. This inevitably has repercussions on consistency of density, so that the quality of the fibre processed by the carding machine is poorer, and so, consequently, is that of the sliver which passes out for further processing.

There is therefore a felt need to produce a duct for the pneumatic feeding of the fibre to at, least one carding machine, and in particular a connector for connecting the said duct to the chute feed of the carding machine, that will ensure good deflection of the fibre towards the said chute but at the same time maintain a uniform and orderly distribution of the fibre sent to each chute.

The problem addressed by the present invention is that of providing a connector for a fibre feeding duct whose structural and functional features will be such as to satisfy the abovementioned needs and at the same time obviate the disadvantages discussed with reference to the prior art.

This problem is solved with a connector in accordance with the main claims given below. Other variants are described in the claims dependent on the main claims.

Other features, and the advantages, of the connector according to the present invention will be apparent in the, description given below of a preferred example of its embodiment, this being provided by way of non-restrictive illustration, with reference to the appended figures, in which.

Figure 1:
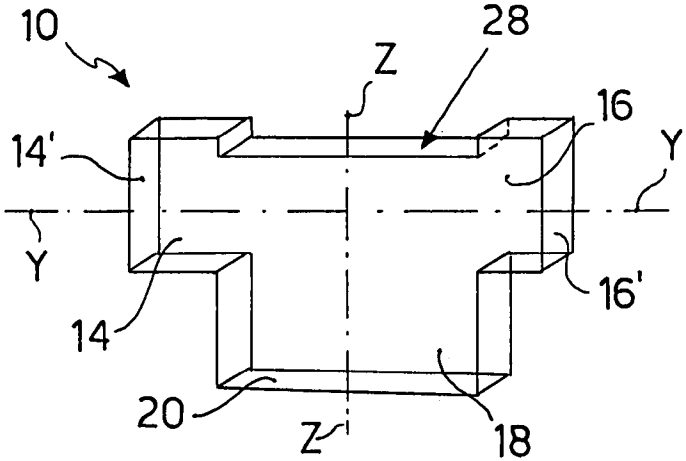
FIGS. 1 to 8 are schematic axonometric views of alternative embodiments of the connector according to the invention.
Figure 2:
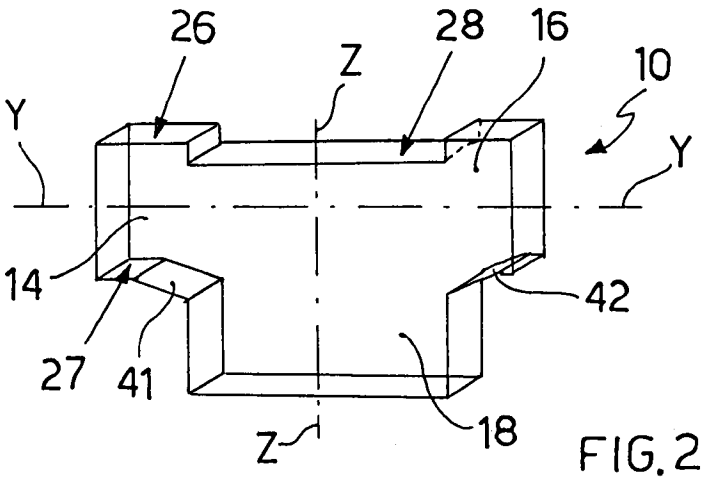
Figure 3:
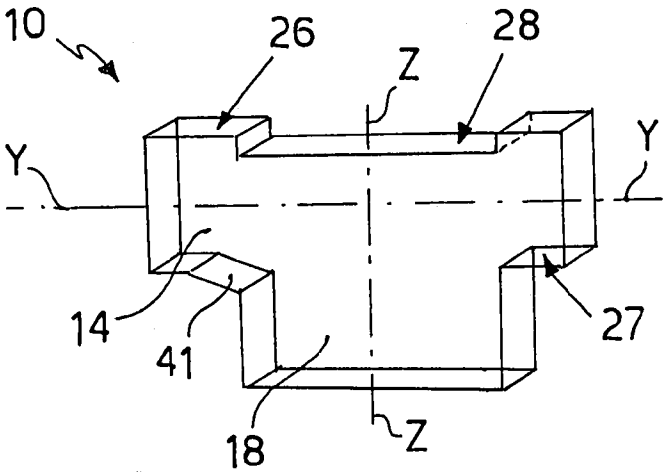
Figure 4:
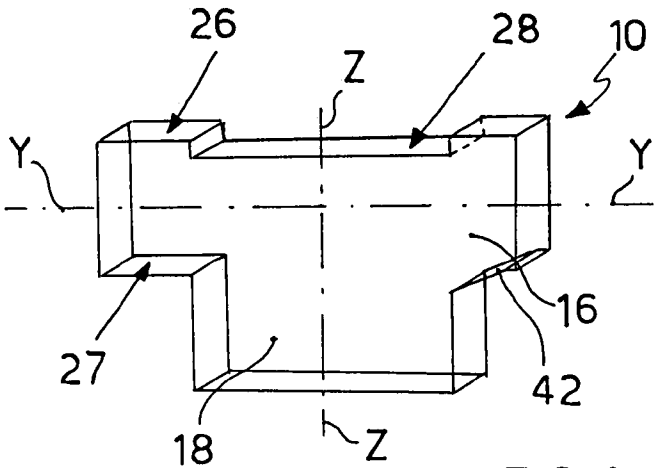
Figure 6:
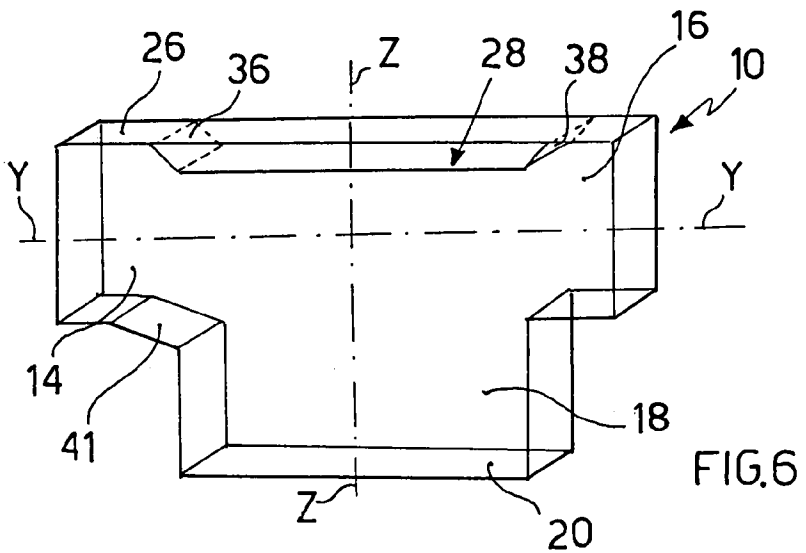
Figure 5:
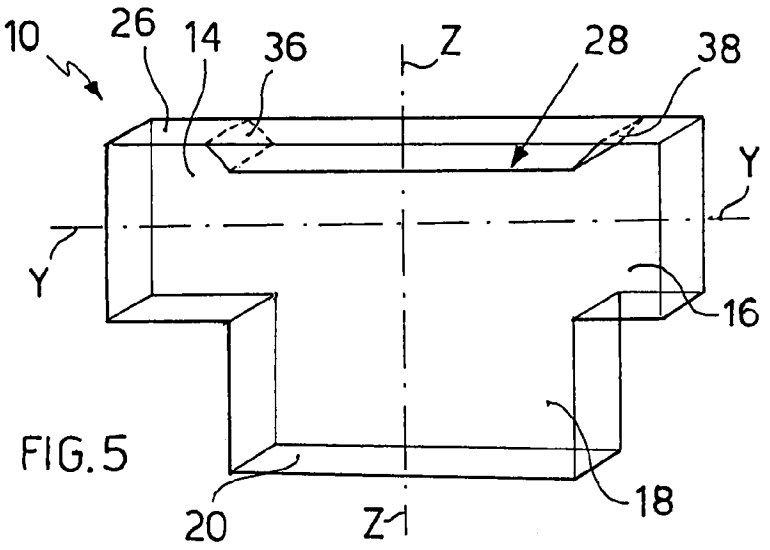
Figure 8:
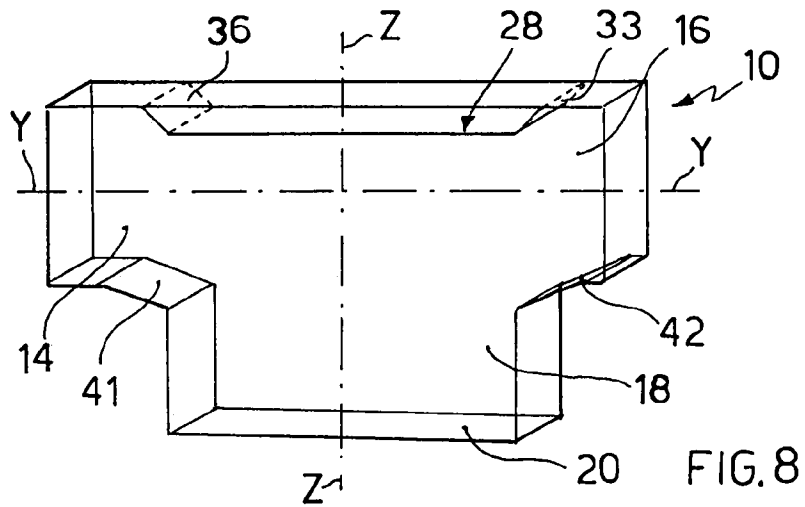
Figure 7:
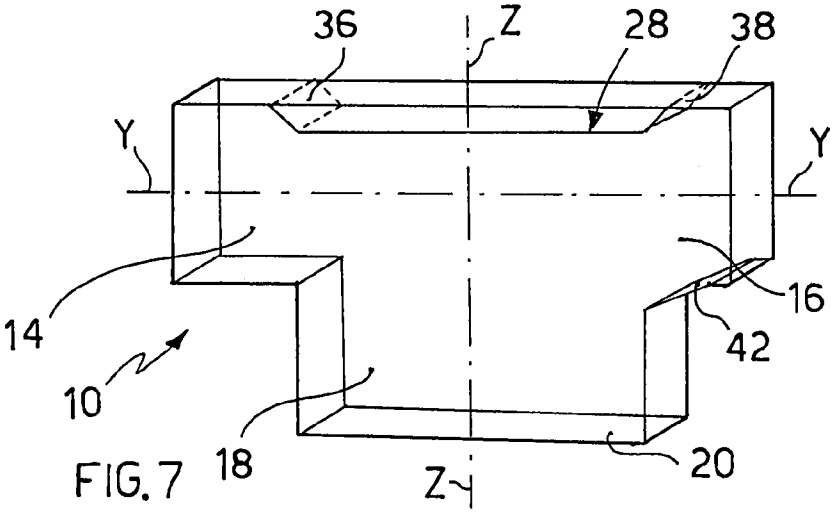
Figure 9:
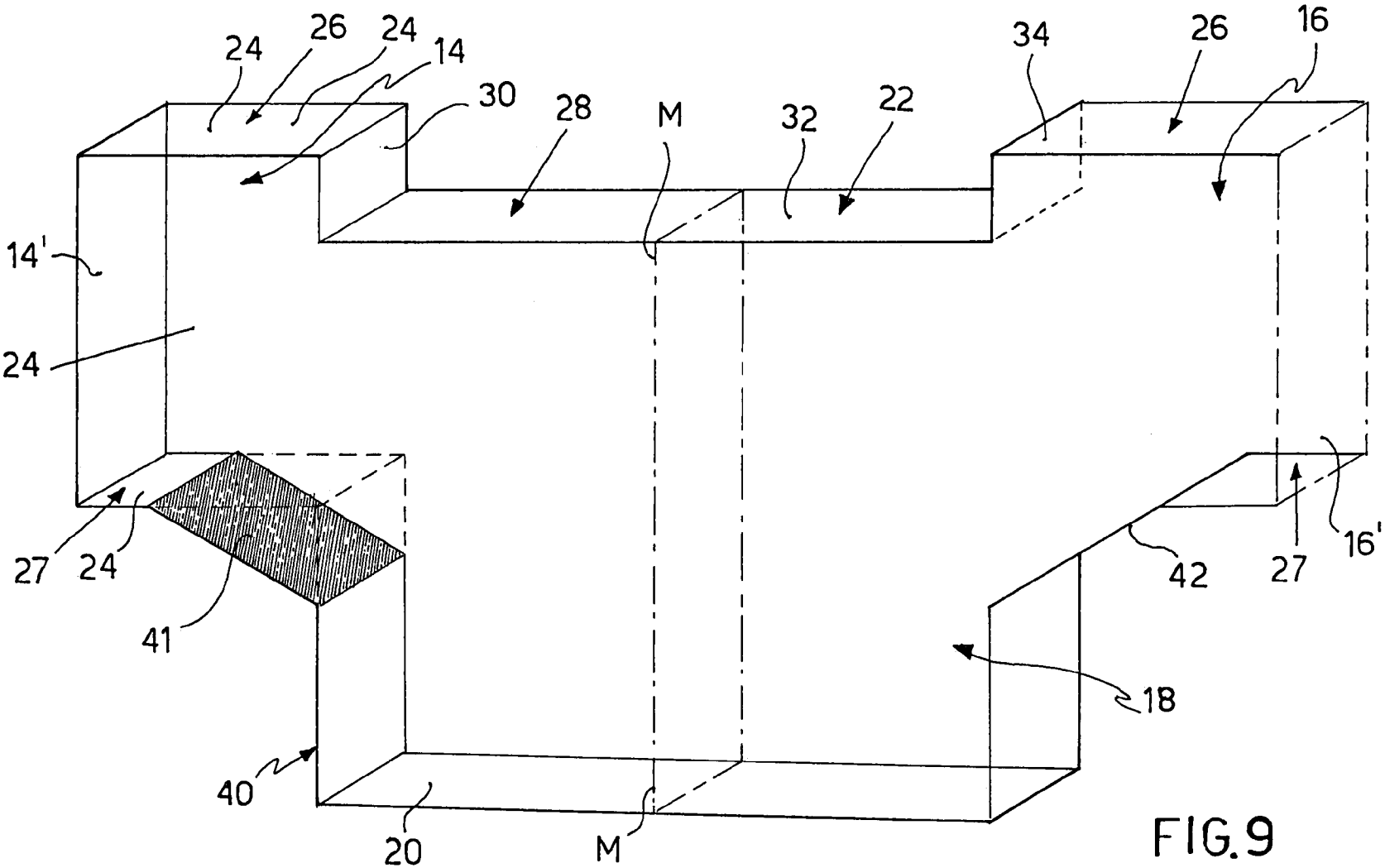
FIG. 9 is a schematic axonometric view of an alternative embodiment of the connector according to the invention.
Figure 10A:
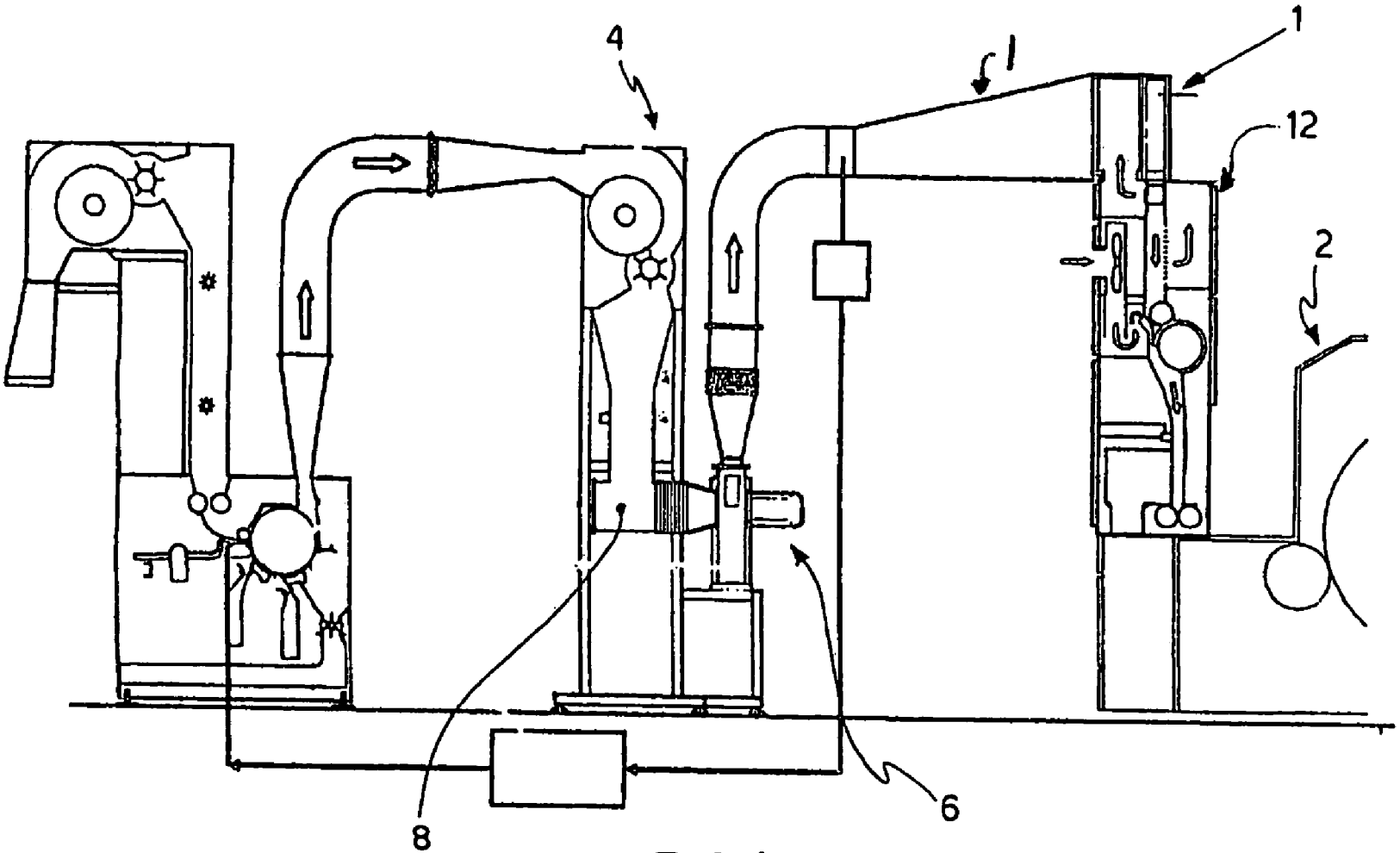
Figure 10B:
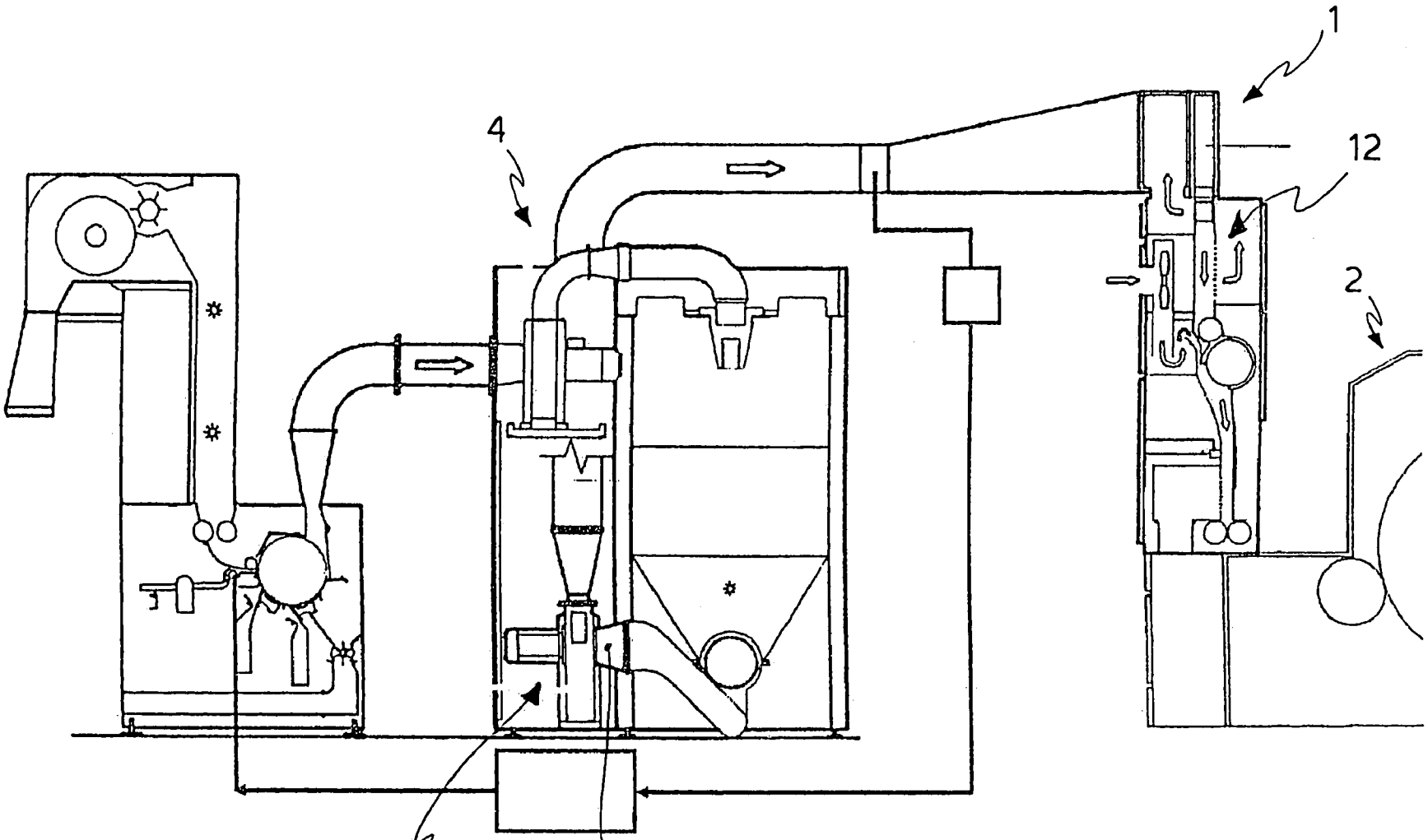
Figure 11C:
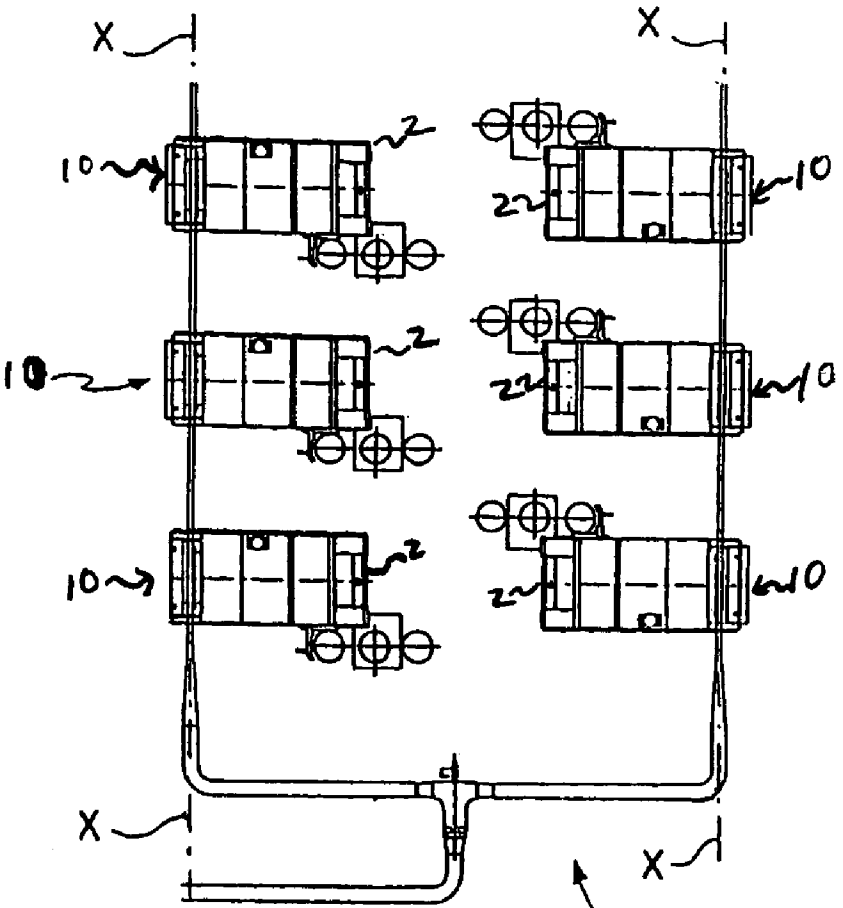
Figure 11A:
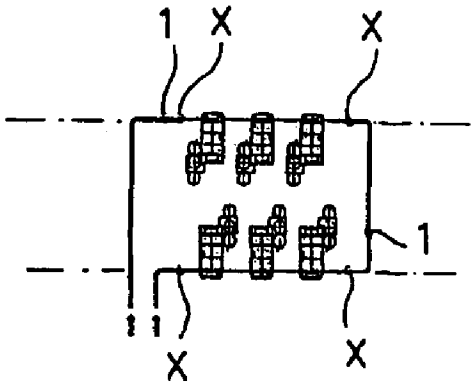
Figure 11B:
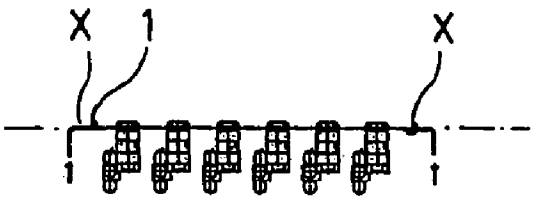
Figure 13:
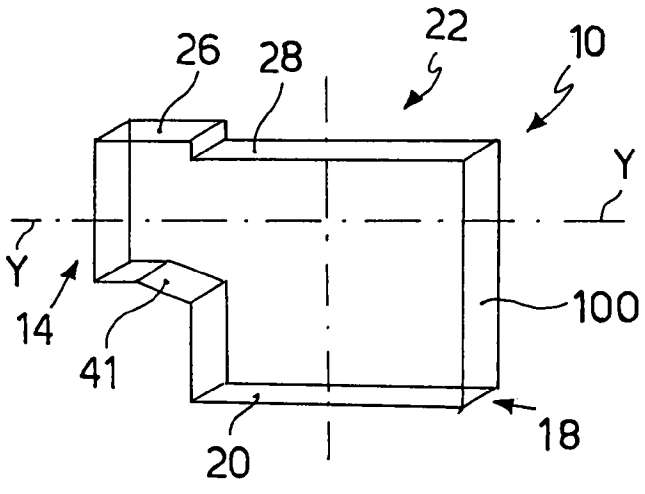
Figure 12:
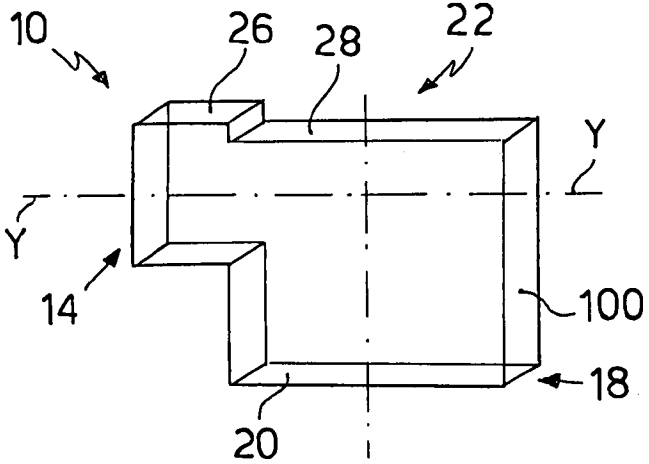
Figure 15:
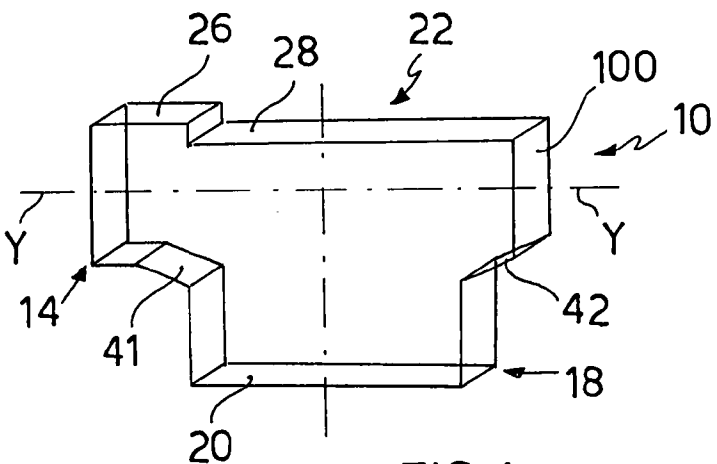
Figure 14:
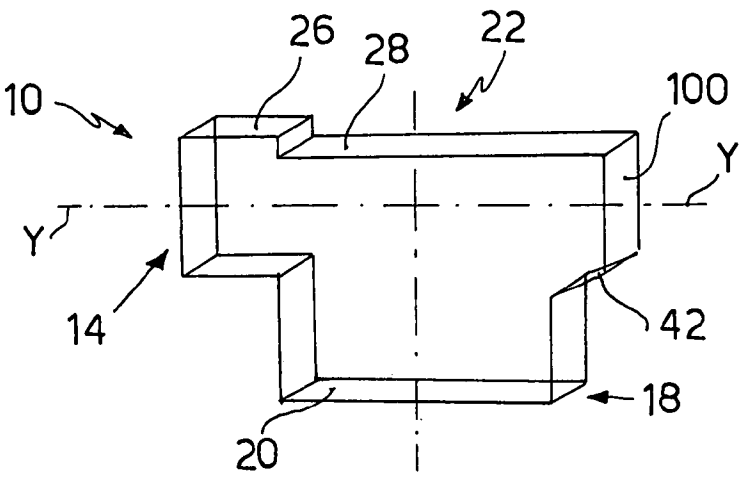
Figure 16:
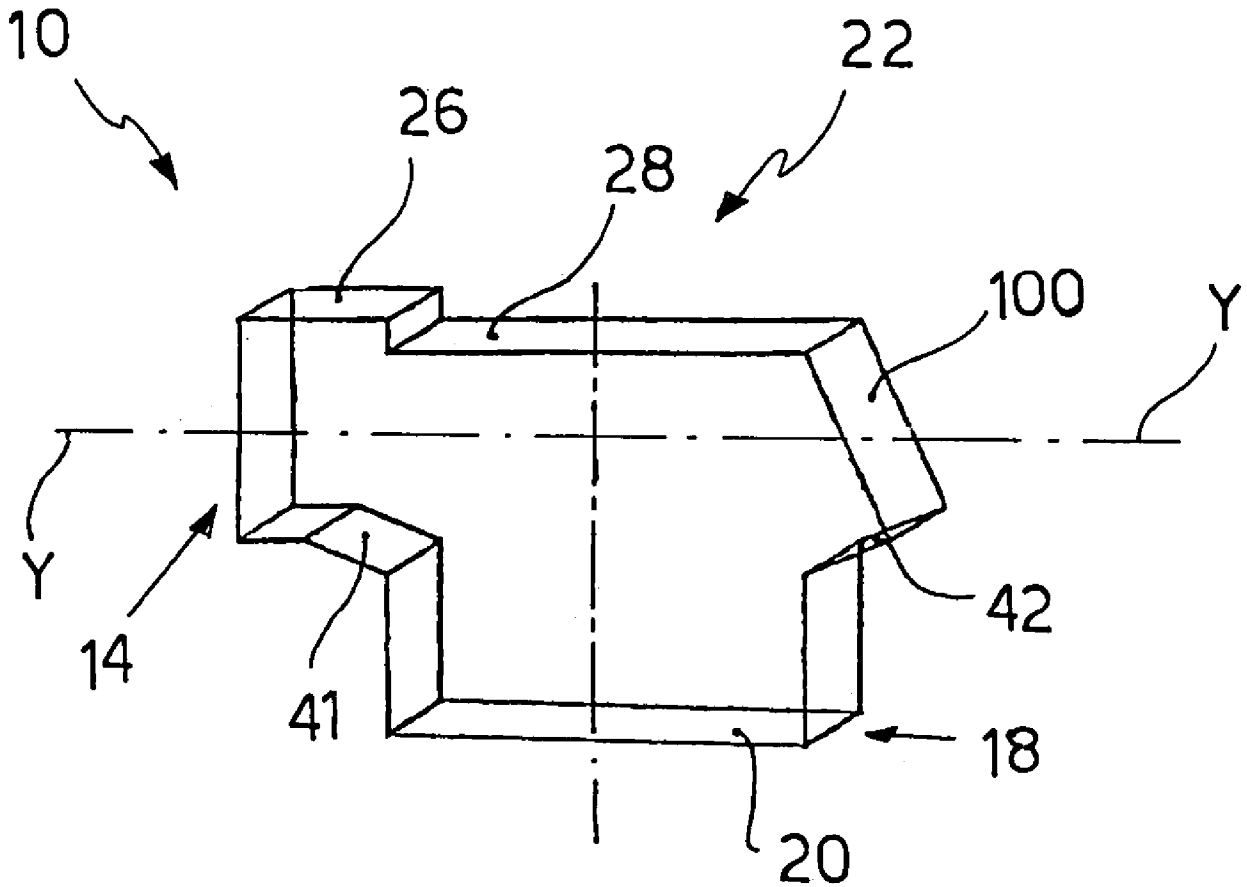

FIGS. 10*a* and 10*b* are schematic transverse views of a portion of a processing line;

FIGS. 11*a* to 11*c* show alternative embodiments of processing lines, and FIGS. 12 to 16 are alternative embodiments of a connector suitable for end-of-line machines.

With reference to the appended figures, reference 1 is a general indication for a duct for the pneumatic feeding of the fibre to one or more carding machines 2.

The feeding duct 1 connects machines 4, upstream of the said carding machines 2, to the carding machines.

In a preferred embodiment, the said duct connects a dust separator or a cage condenser to the said carding machines.

The duct 1 is connected to fan means 6 for generating a stream of air that is channeled into the duct 1 and capable of carrying the fibre along the duct 1.

In other words the fibre is transported along the duct 1 by the propulsive action of the stream of air generated by the said fan means 6, which comprise, for example, a fan 8. This system of transport is known as a pneumatic fibre feeding system.

The duct 1 supplies one or more carding machines 2 in series or in parallel. The said duct extends along a longitudinal duct direction X-X, along which the carding machines are set out.

The latter are provided with a main carding drum rotating about a drum axis. The said drum axis is preferably more or less parallel to the said longitudinal duct direction X-X (FIGS. 11A–11C).

The duct 1 is connected to each carding machine 2 by a connector 10 or distributor. In particular, the said connector 10 connects the duct 1 to a chute feed 12, with which each carding machine 2 is provided.

The connector 10 extends along a longitudinal axis Y-Y. This longitudinal axis Y-Y coincides, in a preferred embodiment, with the longitudinal duct direction X-X.

The connector 10 has, between an upstream connector portion 14 and a downstream connector portion 16, a side duct 18 for transporting the fibre to the carding machine 2.

The opening defined by a plane perpendicular to the longitudinal axis Y-Y of the connector with the upstream portion 14 of the connector 10 defines an upstream opening 14' for the fibre to pass through on its way to the side duct 18 and to the downstream portion 16.

The opening defined by a plane perpendicular to the longitudinal axis Y-Y of the connector with the downstream portion 16 of the connector 10 defines a downstream opening 16' for the fibre to pass through on its way to a subsequent carding machine.

The side duct 18 extends along a side duct axis Z-Z.

In a preferred embodiment the said side duct axis Z-Z is essentially perpendicular to the said longitudinal axis Y-Y of the connector 10.

The opening defined by a plane perpendicular to the side axis Z-Z of the duct with the side portion 18 of the connector 10 defines a through opening 20 for at least some of the fibre to pass through on its way to the carding machine 2.

In other words, in a condition of normal operation of the processing line, the fibre is carried along the duct 1 by a stream of air, arriving in the connector 10 connecting the duct 1 with the carding machine 2 on its way from said upstream connector portion 14.

In the connector 10 the said fibre is distributed, that is some moves towards the downstream connector portion 16, where the fibre is transported to a subsequent carding machine, and some towards the side duct 18, where the fibre is transported to the carding machine 2.

The through opening 20 of the side portion 18 has a centre plane, marked M-M, perpendicular to the said longitudinal axis Y-Y of the connector 10.

The connector 10 also possesses means 22 for deflecting the stream of fibre. These at least partly deflect the said stream of fibre away from the upstream portion 14 of the connector 10 towards the latter's side duct 18.

In a condition of normal operation of the processing line, the fibre, propelled by the stream of air, strikes the said deflection means 22, so that the stream of air and fibre is divided, some proceeding towards the downstream portion 16 of the connector 10 and some towards the side duct 18 of the latter.

The said deflection means 22, preferably located between the upstream portion 14 and the downstream portion 16 of the connector 10, over the through opening 20 where the fibre passes into the side duct 18 form an obstacle which at least partly intercepts the stream of air and fibre, deflecting it from the normal direction of transport in such a way as to facilitate the entry of the said fibre into the side duct 18 of the connector 10.

In one aspect of the present invention, the said means 22 for deflecting the stream of air and fibre have a longitudinal length, meaning a length along the longitudinal axis Y-Y of the connector 10, approximately equal to the longitudinal length of the footprint of the through opening 20 of the side duct 18, as projected onto a plane that contains the longitudinal axis Y-Y of the connector.

In other words, when considering the through opening 20 of the downstream portion 18 and its projection onto a plane passing through the longitudinal axis Y-Y of the connector 10, the said projection forms a footprint on the said plane having its own length in the direction of the longitudinal axis Y-Y. The said longitudinal length of the footprint of the through opening 20 is approximately equal to the longitudinal length of the said deflection means 22.

Advantageously, the means 22 for deflecting the stream of air and fibre extend essentially all the way across the through opening 20 of the downstream portion 18, so that the said fibre is channeled in an essentially uniform manner towards the carding machine 2.

In other words, in normal operation of the processing line, the deflection means 22 are struck by the stream of air and fibre, thus setting up a marked deflection of the stream from the longitudinal direction of the connector 10.

The influence of the said deflection, means 22 on the streamlines creates a uniformity all the way along the longitudinal length of the through opening 20 of the side duct. This encourages homogeneous distribution of the material across the through opening 20, in particular a homogeneous longitudinal density.

In another aspect of the present invention, the means 22 for deflecting the stream of fibre extend symmetrically with respect to the centre plane M-M of the through opening 20 of the connector 10.

In other words the said deflecting means 22 are arranged over the through opening 20 leading to the side duct 18 essentially symmetrically with respect to the centre plane of the through opening 20.

Advantageously, the said symmetrical arrangement enables the stream of air and fibre to be channeling more or less uniformly towards the carding machine.

In other words the symmetrical arrangement of the said deflection means 22 influences the stream of fibre towards the side duct 18 in such a way that the fibre distributes itself uniformly within the said side duct 18 and towards the chute feed of the carding machine 2.

The connector 10 is advantageously useable particularly in double-entry fibre feeding systems.

In another aspect of the present invention, the said connector 10 comprises walls 24 that form a box-like structure. In other words the said walls 24 form in a cross section of the connector 10, that is in a section obtained with a plane perpendicular to the longitudinal axis Y-Y, a rectangular or square cross section.

The said box-like cross section has an upper wall 26 on the opposite side of the said longitudinal axis Y-Y of the connector 10 from the through opening 20 of the side portion 18, and a lower wall 27 opposite the said upper wall.

The means 22 for deflecting the stream of fibre are connected to the upper wall 26 of the connector 10 in such a way as to channel the stream of air and fibre in an essentially uniform manner towards the carding machine 2.

In other words the said deflection means 22 are positioned relative to the upper wall 26 of the connector. 10 in such a way as to set up a propulsive action towards the side duct 18.

The stream of air and fibre undergoes a deflection that facilitates the channeling of the fibre towards the side duct and, at the same time, only slightly influences the stream of air and fibre directed towards the downstream portion 16. In other words, the said deflection means allow rapid re-establishment of the ideal conditions for feeding of the fibre to the next connector and deflection of the fibre towards the next carding machine.

In a preferred embodiment the said deflection means 22 are integral with the said upper wall 26.

The said deflection means 22 are preferably realized as a step 28 projecting from the said upper wall 26 of the connector 10 towards the through opening 20 of the side duct 18.

The said step 28 has a forward surface 30 which is struck, during normal operation of the processing line, by the stream of fibre through the duct; a lower surface 32 of basically longitudinal extension; and, opposite the said forward surface 30, a rear surface 34.

In one aspect of the invention the said lower surface 32 of the step 28 has a longitudinal length approximately equal to the longitudinal length of the through opening 20 of the side duct 18.

In another aspect of the invention, the said lower surface is essentially symmetrical about the centre plane of the through opening 20 of the side duct 18.

In accordance with a preferred embodiment, the said step 28 has at least one lead-in wall to join the upper wall 26 of the connector 10 to the said step 28. In particular, the said step 28 has a forward lead-in wall 36, struck by the stream of fibre, and/or, opposite the front lead-in wall, a rear lead-in wall 38.

The side duct 18 of the connector 10 comprises walls 40 which define a box-like section. The said side duct 18 preferably has a width, i.e. a dimension in the direction of the longitudinal axis Y-Y of the connector 10, which is approximately equal to the working width of the carding machine, i.e. to the width of the main carding drum in the direction of the drum axis.

The said side duct 18 is preferably joined to the lower wall 27 of the connector 10 by at least one bevel.

In particular, the said side duct 18 is joined to the lower wall 27 of the upstream portion 14 of the connector 10 by a first bevel 41 and/or to the lower wall 27 of the downstream portion 16 of the connector 10 by a second bevel 42.

In other words, in a variant of the connector according to the invention, the lower wall 27 of the upstream portion 14 connects to the wall of the side duct 18 by a bevel wall 41 lying on a bevel plane not parallel to the longitudinal axis Y-Y of the connector 10.

In another embodiment, the said bevel wall 41 lies on a plane inclined with respect to the said longitudinal axis of the connector so as to form for the fibre transported in the feeding duct a lead-in towards the said side portion 18 of the connector 10.

In a variant of the connector, the lower wall 27 of the downstream portion 16 connects to the wall of the side duct 18 by a bevel wall 42 lying on a plane not parallel to the longitudinal axis Y-Y of the connector 10.

In another embodiment, the said bevel wall 42 lies on a plane inclined with respect to the said longitudinal axis of the connector so as to form for the fibre transported from the upstream portion towards the downstream portion a lead-in towards the said downstream portion 16.

The said first bevel 41 forms a lead-in for the transportation of the fibre towards the side duct 18 and, at the same time, an increase in the area of the upstream opening 14' through which the fibre travels.

The said bevel, together with the deflection means, encourages a redistribution of the throughput owing to a reduction in the pressure gradient which the streamlines close to the said bevel have to undergo in order to be pushed towards the feeding duct.

In other words, while the said first bevel 41 produces an increase in the area of the upstream opening 14', positively influencing the uniformity of the pressure of the fibre transported through the connector in the side duct 18, this effect is accompanied by the presence of the deflection means, in particular by the "stepped" configuration of the latter.

To put it yet another way, the increase in the area of the upstream opening 14' due to the first bevel 41 is accompanied in its effects by the "stepped" configuration of the deflection means.

The said second bevel 42 helps the fibre to keep moving through the connector from the upstream portion 14 to the downstream portion 16, and, at the same time, reduces the area of the downstream opening 16' of the connector 10.

In one aspect of the present invention, along the longitudinal length of the side duct 18, the said pressure distribution conditions are influenced advantageously by the said deflection means which extend for more or less the entire longitudinal length of the said side duct.

In a further aspect of the present invention, along the longitudinal length of the side duct 18, the said pressure conditions are influenced advantageously by the said deflection means, whose configuration is essentially symmetrical with respect to the centre plane of the through opening 20 of the side portion 18, thereby ensuring that dissymmetries in the configuration of the said deflection means are not translated into a dissymmetry of the fibre streamlines between the upstream portion and the downstream portion, which would cause dissymmetries in the deposition of the fibre.

In one embodiment of the invention, the connector 10 is suitable for use as an end-of-line distributor (FIGS. 12 to 16).

In particular, in the abovementioned embodiment, the connector 10 extends along the longitudinal axis Y-Y and exhibits the upstream portion 14, from where the said fibre arrives, and the side duct 18, with its through opening 20, for transporting the fibre to the end-of-line carding machine 2.

The connector 10 also includes means 22 for deflecting the stream of fibre, the said means being struck, in a condition of normal operation, by the said stream of fibre and being able to deflect the said stream of fibre from the upstream portion 14 towards the side duct 18.

The means 22 for deflecting the stream of fibre have a longitudinal length approximately equal to the longitudinal length of the footprint of the said through opening 20 of the side duct 18 of the connector, as projected onto a plane passing through the longitudinal axis Y-Y of the connector, so as to channel the said fibre in an essentially uniform manner towards the carding machine.

The connector 10 comprises walls that form a box-like structure having an upper wall 26 on the opposite side of the said longitudinal axis Y-Y of the connector from the said through opening 20 through which the fibre passes.

The means 22 for deflecting the stream of fibre are preferably connected to the said upper wall 26 of the connector 10.

In a variant, the said deflection means 22 are integral with the said upper wall 26 of the connector 10.

In another embodiment, the said deflection means 22 are removable from the said upper wall 26 of the connector 10.

The deflection means 22 comprise a step 28 projecting from the upper wall 26 of the said connector towards the through opening 20 of the side duct 18.

The step 28 preferably comprises at least one lead-in wall to join the upper wall 26 to the said step 28.

The side duct 18 is preferably joined to the upstream portion 14 by a first bevel wall 41.

Furthermore, the said connector 10 comprises a closing wall 100 which closes the feeding duct and channels the fibre towards the end-of-line machine.

In one embodiment, the said closing wall is perpendicular to the longitudinal axis Y-Y of the duct.

In another embodiment, the said closing wall 100 is inclined with respect to the said longitudinal axis Y-Y.

In a further embodiment, the said connector 10 comprises a second bevel wall 42 that joins the said closing wall 100 to the said side duct.

Unusually, the connector of a pneumatic fibre feeding duct according to the invention achieves good deflection of the fibre towards the carding machine and simultaneously maintains a uniform and orderly distribution of the fibre sent to each chute feed.

The presence of the said deflection means facilitates the channeling of the fibre towards the carding machine.

This compares with known constructions, where a strong tendency has been found for the majority of the transported fibre to end up at the last carding machines of the feeding line, resulting in uneven working conditions for the machines making up the line.

Furthermore, the fact that the longitudinal length of the deflection means is approximately equal to the longitudinal length of the through opening of the side duct of the connector enables fibre transportation conditions to be kept uniform and homogeneous across the said through opening.

This enables homogeneous fibre densities to be maintained across the full working width of the carding machine, that is across the full working width of the main carding drum.

In accordance with another advantageous aspect, the said connector comprises lead-ins for the fibre for channeling it towards the side duct without the formation, for example around a sharp join between the upstream portion and the side portion, of regions of stationary fibre which would have the effect of reducing the crosssectional area through which fibre can pass and creating regions of non-uniform flow.

In accordance with yet another advantageous aspect, the said connector comprises lead-ins for the fibre for directing it towards the downstream portion of the connector without regions of impact of the fibre against a wall, for example around a sharp join between the side duct and the downstream portion, which would disturb the smooth flow of fibre in the downstream direction.

Advantageously, moreover, the construction of the said deflection means in a "stepped" configuration integrally with the upper wall of the connector provides a simple and inexpensive construction of this connector.

It will be clear that a person skilled in the art will be able to make numerous modifications and alterations to the fibre feeding duct connector described above in order to fulfill any specific requirements that may arise.

For example, in another embodiment, the said deflection means comprise a longitudinal succession of mutually separate elements which, taken together, extend longitudinally over a distance approximately equal to the longitudinal length of the footprint of the through opening of the terminal portion.

It will be clear that such variants are to be understood as coming within the scope of protection as defined by the following claims.

The invention claimed is:

1. Connector (10) for a duct (1) for the pneumatic feeding of fibre to a carding machine (2), the said connector extending along a longitudinal axis (Y-Y) and having an upstream portion (14), from where the said fibre arrives, and a side duct (18) having a through opening (20) for fibre feeding to the carding machine (2), and also comprising means (22) for deflecting the stream of fibre, the said means being struck, in a condition of normal operation, by the said stream of fibre and being able to deflect the same stream of fibre from the upstream portion (14) of the connector (10) towards the side duct (18) of the latter, in which said means (22) for deflecting the stream of fibre have a longitudinal length as projected onto a plane passing through the longitudinal axis (Y-Y) of the connector, so as to channel the said fibre in an uniform manner towards the carding machine (2), and in which said side duct (18) has a centre plane (M-M) perpendicular to the longitudinal axis (Y-Y) of the connector (10), and in which the connector (10) comprises walls (24) that form a box-like structure having an upper wall (26) on the opposite side of the longitudinal axis (Y Y) of the connector from the through opening (20), and in which said means (22) for deflecting the stream of fibre are connected to the upper wall (26) of the connector (10), and in which the deflection means (22) comprise a step (28) projecting from the upper wall (26) of the connector towards the through opening (20) of the side duct (18), and in which said step (28) has a forward surface (30) which is struck, during normal operation of the processing line, by the stream of fibre, a lower surface (32) of longitudinal extension and, opposite the forward surface (30), a rear surface (34).

2. Connector (10) according to claim 1, also comprising a downstream portion (16) for feeding the fibre to a subsequent carding machine, the said deflection means (22) being able to deflect at least some of the said stream of fibre from the upstream portion (14) towards the side duct (18).

3. Connector (10) according to claim 1, also comprising a closing wall (100), the said deflection means (22) being able to deflect the said stream of fibre from the upstream portion (14) towards the side duct (18) connected to an end-of-line carding machine.

4. Connector (10) according to claim 1, in which the said deflection means (22) form an obstacle which at least partly intercepts the stream of transported fibre.

5. Connector (10) according to claim 1, in which said means (22) for deflecting the stream of fibre extend symmetrically with respect to the centre plane of the side duct (18) of the connector.

6. Connector (10) according to claim 5, in which said lower surface (30) fibre is symmetrical about the centre plane of the through opening (20) of the side duct (18).

7. Connector (10) according to claim 1, in which said lower surface (30) is parallel to the longitudinal axis (Y-Y) of the connector.

8. Connector (10) according to claim 7, in which said lower surface (30) has a longitudinal length equal to the longitudinal length of the through opening (20) of the side duct (18).

9. Connector (10) according to claim 1, in which said deflection means (22) are integral with the upper wall (26) of the connector (10).

10. Connector (10) according to claims 1, in which the deflection means (22) are removable from the upper wall (26) of the connector (10).

11. Connector (10) according to claim 1, in which the said side duct (18) comprises walls (40).

12. Connector (10) according to claim 11, in which the side duct (18) is joined to the upstream portion (14) by a first bevel wall (41).

13. Connector (10) according to claim 12, also comprising a downstream portion (16) for feeding the fibre to a subsequent carding machine, the said deflection means (22) being able to deflect at least some of the said stream of fibre from the upstream portion (14) towards the side duct (18), and in which the side duct 18 is joined to the downstream portion (16) by a second bevel (42).

14. Connector (10) according to claim 1, in which the means (22) for deflecting the stream of air and fibre extend all the way across the through opening (20).

15. Connector (10) according to claim 1, in which the front surface (30) is perpendicular to the longitudinal axis (Y-Y).

16. Connector (10) according to claim 1, in which the front surface (30) a forward lead-in wall inclined to the longitudinal axis (Y-Y).

17. Connector (10) according to claim 1, in which the rear surface (34) is perpendicular to the longitudinal axis (Y-Y).

18. Connector (10) according to claim 1, in which the rear surface (34) is a rear lead-in wall inclined to the longitudinal axis (Y-Y).

19. Duct (1) for the pneumatic feeding of fibre to a carding machine, comprising a connector (10), wherein the connector extends along a longitudinal axis (Y-Y) and has an upstream portion (14), from where the said fibre arrives, and a side duct (18) having a through opening (20) for fibre feeding to the carding machine (2), and also comprises means (22) for deflecting the stream of fibre, the said means being struck, in a condition of normal operation, by the said stream of fibre and being able to deflect the said stream of fibre from the upstream portion (14) of the connector (10) towards the side duct (18) of the latter, in which said means (22) for deflecting the stream of fibre having a longitudinal length, as projected onto a plane passing through the longitudinal axis (Y-Y) of the connector, so as to channel the said fibre in an uniform manner towards the carding machine (2), and in which said side duct (18) has a centre plane (M-M) perpendicular to the longitudinal axis (Y-Y) of the connector (10), and in which the connector (10) comprises walls (24) that form a box-like structure having an upper wall (26) on the opposite side of the longitudinal axis (Y-Y) of the connector from the through opening (20), and in which said means (22) for deflecting the stream of fibre are connected to the upper wall (26) of the connector (10), and in which the deflection means (22) comprise a step (28) projecting from the upper wall (26) of the connector towards the through opening (20) of the side duct (18), and in which said step (28) has a forward surface (30) which is struck, during normal operation of the processing line, by the stream of fibre, a lower surface (32) of longitudinal extension and, opposite the forward surface (30), a rear surface (34).

20. Duct (1) according to claim 19, in which the duct is connected to fan means (6).

21. Duct (1) according to claim 20, in which the fan means (6) comprise a fan (8).

22. Connector (10) according to claim 21, in which the said deflection means (22) have a stepped configuration.

23. Connector (10) according to claim 22, in which the said step is integral with the said upper wall (26) of the connector (10).

24. Connector (10) for a duct (1) for the pneumatic feeding of fibre to an end-of-line carding machine(2), the said connector extending along a longitudinal axis (Y-Y) and having an upstream portion (14), from where the said fibre arrives, and a side duct (18) having a through opening (20) for fibre feeding to the carding machine (2), and also comprising means (22) for deflecting the stream of fibre, and said means being struck, in a condition of normal operation, by the said stream of fibre and being able to deflect the said stream of fibre from the upstream portion (14) of the connector (10) towards the side duct (18) of the latter, which connector is characterized in that the said means (22) for deflecting the stream of fibre have a longitudinal length substantially equal to the longitudinal length of the footprint of the said through opening (20) of the side duct (18) of the connector, as projected onto a plane passing through the longitudinal axis (Y-Y) of the connector, so as to channel the said fibre in a substantially uniform manner towards the carding machine (2), wherein the said side duct (18) has a centre plane (M-M) perpendicular to the said longitudinal axis (Y-Y) of the connector (10), and the said means (22) for deflecting the stream of fibre extend symmetrically with respect to the said centre plane of the side duct (18) of the connector.

25. Connector according to claim 24 to, in which the said connector (10) comprises walls (24) that form a box-like structure having an upper wall (26) on the opposite side of the said longitudinal axis (Y-Y) of the connector from the said through opening (20) through which the fibre passes.

26. Connector (10) according to claim 25, in which the said means (22) for deflecting the stream of fibre are connected to the said upper wall (26) of the connector (10).

27. Connector (10) according to claim 26, in which the said deflection means (22) are able to channel the said fibre in a substantially uniform manner towards the carding machine (2).

28. Connector (10) according to claim 25, in which the said deflection means (22) are integral with the said upper wall (26) of the connector (10).

29. Connector (10) according to any claim 25, in which the said deflection means (22) are removable from the said upper wall (26) of the connector (10).

30. Connector (10) according to claim 24, in which the said deflection means (22) comprise a step (28) projecting form an upper wall (26) of the said connector towards the through opening (20) of the side duct (18).

31. Connector (10) according to claim 30, in which the said step (28) comprises at least one lead-in wall to join the upper wall (26) to the said step (28).

32. Connector (10) according to claim 24, in which the said side duct (18) comprises walls (40).

33. Connector (10) according to claim 32, in which the said side duct (18) is joined to the said upstream portion (14) by a first bevel wall (41).

34. Connector (10) according to claim 24, also comprises a closing wall (100) which closes the feeding duct and channels the fibre towards the said carding machine.

35. Connector (10) according to claim 34, in which the said closing wall (100) is perpendicular to the longitudinal axis (Y-Y) of the duct.

36. Connector (10) according to claim 34, in which the said closing wall (100) is inclined with respect to the longitudinal axis (Y-Y) of the duct.

37. Connector (10) according to claim 34, also comprises a second bevel wall (42) joining the said closing wall (100) to the said side duct (18).

38. Duct (1) for the pneumatic feeding of fibre to a carding machine, comprising a connector (10) according to claim 24.

* * * * *